US007753739B2

(12) United States Patent
Bentler et al.

(10) Patent No.: US 7,753,739 B2
(45) Date of Patent: Jul. 13, 2010

(54) ELECTRICAL TERMINAL BLOCK

(75) Inventors: Harry Bentler, Luedge (DE); Michael Strato, Steinheim (DE); Thorsten Diessel, Hiddenhausen (DE); Heinz Reibke, Bad Salzuflen (DE); Carsten Pollmann, Steinheim (DE); Heinz Pannek, Paderborn (DE)

(73) Assignee: Phoenix Contact GmbH & Co. KG, Blomberg (DE)

( * ) Notice: Subject to any disclaimer, the term of this patent is extended or adjusted under 35 U.S.C. 154(b) by 0 days.

(21) Appl. No.: 12/465,790

(22) Filed: May 14, 2009

(65) Prior Publication Data

US 2009/0221191 A1 Sep. 3, 2009

Related U.S. Application Data

(62) Division of application No. 11/622,656, filed on Jan. 12, 2007, now Pat. No. 7,537,496.

(30) Foreign Application Priority Data

Jan. 20, 2006 (DE) ..... 10 2006 003 064

(51) Int. Cl.
*H01R 9/22* (2006.01)

(52) U.S. Cl. ..... 439/709; 439/532; 439/716

(58) Field of Classification Search ..... 439/709, 439/94, 532, 716, 835
See application file for complete search history.

(56) References Cited

U.S. PATENT DOCUMENTS 3,201,747 A * 8/1965 Blanchet ..... 439/716
3,710,301 A * 1/1973 Weimer ..... 439/213
4,516,189 A 5/1985 Seaks, Jr.
5,741,142 A 4/1998 Dux et al.
6,146,213 A 11/2000 Yoon
6,425,770 B1 * 7/2002 Lostoski et al. ..... 439/76.1
6,506,071 B2 1/2003 Lange
6,521,837 B2 * 2/2003 Hilgert et al. ..... 174/99 B

FOREIGN PATENT DOCUMENTS

DE 30 38 833 A1 5/1982
DE 196 35 821 C1 11/1997

* cited by examiner

*Primary Examiner*—Tho D Ta
*Assistant Examiner*—Travis Chambers
(74) *Attorney, Agent, or Firm*—David S. Safran; Roberts Mlotkowski Safran & Cole, P.C.

(57) ABSTRACT

An electrical terminal block, especially for locking onto a mounting rail, has a plurality of adjacent base terminals and connectors. Each base terminal has a terminal housing, with at least one conductor terminal element and at least one receptacle electrically connected to the conductor terminal element or at least two interconnected receptacles. The individual connectors have a connector housing, with at least one conductor terminal element and a plug-in contact electrically connected to the conductor terminal element. The individual connectors can be plugged onto the individual terminal housings. Reliable mechanical fixing of the connectors on the base terminals is ensured since each outer side of the base terminals has a fixing device on the terminal housing. Sides of adjacent connectors have a fixing cover with a fixing mechanism corresponding to the fixing device, so that the connectors can be mechanically connected to the fixing base terminals via the fixing covers.

5 Claims, 4 Drawing Sheets

ELECTRICAL TERMINAL BLOCK

CROSS REFERENCE TO RELATED APPLICATION

This application is a divisional of commonly owned, U.S. patent application Ser. No. 11/622,656, filed Jan. 12, 2007, now U.S. Pat. No. 7,537,496.

BACKGROUND OF THE INVENTION

1. Field of the Invention

The invention relates to an electrical terminal block, especially for locking onto a mounting rail. The invention particularly relates to electrical terminal blocks having a plurality of base terminals located next to one another and a plurality of connectors located next to one another and mounted on the base terminals.

2. Description of Related Art

Electrical series terminals have been known for decades and are being used in the millions in the wiring of electrical systems and devices. Series terminals are generally locked onto mounting rails that are often located in multiples in a control cabinet. The series terminals are generally made as connecting terminals so that they have at least two conductor terminal elements that are electrically connected to one another via an electrically conductive connecting bar, known as the conductor bar. In addition to this basic type of series terminals, there are many different types of series terminals that are especially adapted to the particular applications. Examples of the different types are two-tier or three-tier terminals and three-wire or four-wire terminals, which then each have a correspondingly larger number of conductor terminal elements.

In addition, there are also electrical series terminals in which at least one conductor terminal element is replaced by a receptacle. In that case, a connector having a corresponding plug-in contact can be plugged onto this receptacle. The conductor terminal element for connecting the electrical conductor is located in the housing of the connector.

Such an electrical series terminal is known from German Utility Model DE 295 14 711 U1. In this disclosure, the base terminal is generally locked onto a mounting rail so that the base terminal represents the stationary part of the electrical series terminal. Conversely, the connector forms the movable part of the electrical series terminal, since it can be easily plugged onto and pulled off of the corresponding receptacles of the base terminal by means of its plug-in contact. While the electrical supply lines are connected to the base terminal or to the conductor terminal elements located in the base terminal, the electric lines of the individual consumers are connected to the conductor terminal elements in the connector.

Since electrical series terminals are generally made disk-shaped, they are assembled generally with several other electrical series terminals to form a terminal block. In these known electrical series terminals, it is then possible to reduce wiring work and also installation efforts by connecting the electrical conductors of individual consumers to a corresponding number of connectors. Then, the connectors that can be combined into a connector block need to simply be inserted into a base terminal block, the base terminal block having been assembled from the corresponding number of base terminals.

Conductor terminal elements in series terminals are largely screw terminals or spring force terminals, especially tension spring terminals. The clamping principle in tension spring terminals is similar to that of screw technology. While in the screw terminal a tension sleeve pulls the conductor against the conductor bar by actuating a terminal screw, in a tension spring terminal this task is performed by the tension spring. To do this, the pretensioned tension spring is opened with an actuating tool, for example a screw driver, so that the conductor can be inserted through a window in the spring leg of the tension spring into the terminal space. After removing the actuating tool, the conductor is pulled by the spring force of the tension spring against the conductor bar.

Both in the screw terminal and in the tension spring terminal, the electrical conductor must first be stripped after it is cut to length before the electrical conductor can make contact. Since a special tool is necessary for stripping the electrical conductor, and since stripping is relatively time-consuming, for many years electrical terminals have also been used to which electrical conductors can be connected without prior stripping. To do this, the insulated conductor is inserted into a conductor receiver in the housing of the terminal and then pressed into an insulation piercing element, by which the insulation of the conductor is cut through and contact is made with the core of the conductor by the insulation piercing elements.

For reliable mechanical connection of connectors and the base terminal, in the electrical series terminal known from German Utility Model DE 295 14 711 U1, there is a fixing element that is fixed to the front of the connector and extends behind the housing projection on the front of the base terminal. In known electrical series terminals, the base terminal has two receptacles, but the connector can only be plugged into the outer of the two receptacles, since otherwise the connector can no longer be fixed on the base terminal with the fixing element.

German Patent Application DE 100 45 498 A1, which corresponds to U.S. Pat. No. 6,506,071, likewise discloses an electrical series terminal with a base terminal and two connectors. In this series terminal in the terminal housing of the base terminal between the two receptacles, a locking element is formed so that the connector at both receptacles can be mechanically connected to the terminal housing of the base terminal. Forming a locking element in the base terminal thus obviates the necessity of placing the connector on the outer receptacle, so that the fixing element can be locked laterally on the connector housing of the base terminal.

In the electrical series terminal described above, however, a separate fixing element is necessary that connects the connector on the front to the base terminal. If the fixing element is lost, it is possible that a connector can be unintentionally pulled out of the base terminal. This is especially true when several connectors are to be combined into a connector block, and a plurality of fixing elements are necessary to ensure reliable and permanent mechanical fixing of the connectors on the base terminals.

SUMMARY OF THE INVENTION

Therefore, an aspect of this invention is to embody and develop an electrical terminal block consisting of several base terminals and several connectors such that reliable mechanical fixing of the connectors to the base terminals can be ensured. Moreover, the number of interconnected base terminals and number of connectors combined with one another into a connector block is freely selectable. A connector is made available which alone or together with other connectors can be reliably fixed on the base terminal or several base terminals.

This and other aspects can be achieved by this invention in which an electrical terminal block, especially for locking onto a mounting rail, includes a plurality of base terminals located next to one another and a plurality of connectors, the individual base terminals each having a terminal housing, with at least one conductor terminal element located therein and at least one receptacle that is electrically connected to the conductor terminal element or with at least two interconnected receptacles. The individual connectors each have a connector housing, with at least one conductor terminal element located therein and one plug-in contact that is electrically connected to the conductor terminal element. The individual connectors can be plugged onto the individual terminal housings of the base terminal.

In addition, the invention relates to a modular unit of at least one connector and two fixing covers located on each side of the connector or outer side of a plurality of connectors for plugging the connectors onto a number of base terminals that correspond to the number of connectors. The invention also relates to a fixing cover per se for fixing on one side of the connector housing of a connector.

In particular, in the invention the outer sides of a block formed of a plurality of base terminals located next to one another each have a fixing base terminal connected thereto. Each fixing base terminal has a fixing terminal housing with at least one fixing device. Further, on the outer sides of a block formed of a plurality of connectors located next to one another there is a fixing cover. Each fixing cover has a fixing mechanism corresponding to the fixing device so that the block of connectors can be connected mechanically to the block of base terminals via the fixing covers.

As explained herein, the mechanical fixing of the connectors, which have been joined to one another into a connector block, no longer takes place on the front of the connector or the front of the base terminal, but rather perpendicular to the front, specifically by an arrangement of two fixing base terminals and the use of two fixing covers on the two lengthwise sides of the base terminal block or of the connector block. A plurality of the connectors located next to one another forming a block is thus encompassed or bordered laterally by the fixing covers, which can be mechanically fixed using a fixing mechanism on the fixing base terminals that are located laterally next to a block of base terminals.

According to one configuration, in the terminal housing of the fixing base terminals at least two fixing devices are formed that are located in succession in the lengthwise direction of the fixing base terminal. Moreover, the fixing mechanism of the fixing cover is located off-center with respect to the lengthwise direction of the fixing cover so that two fixing covers arranged on the sides of adjacent connector housings or connector blocks can be jointly mechanically connected to one fixing base terminal. The off-center arrangement of the fixing mechanism and the arrangement of two fixing devices in succession then allow one fixing mechanism for each cover to interact with one fixing device at a time.

The mechanical connection between the fixing device made in the fixing base terminal and the fixing mechanism made on the fixing cover can be executed as a catch connection. Preferably, this connection is made as a screw connection, for which the fixing device or devices in the terminal housing of the fixing base terminal is or are made as a threaded insert and the fixing covers have a screw receiver and a screw as the fixing mechanism. This ensures reliable and permanent mechanical fixing of the fixing cover, and thus of the connector, on the fixing base terminal by a corresponding screw being inserted into the screw receiver on the fixing cover and then being screwed into the threaded insert in the fixing base terminal.

Because the fixing base terminals and the fixing covers are made as separate components, the number of base terminals that can be connected to form a base terminal block or the number of connectors that can be joined into a connector block is freely selectable. It is possible to mechanically connect only one connector by means of two fixing covers via the two fixing base terminals to one base terminal. Generally, several connectors, for example three, four, five or six connectors, will be located between two fixing covers, which are then plugged and fixed on a base terminal block that consists of a corresponding number of base terminals and has a fixing base terminal on both sides of the block.

Preferably, the mechanical connection of the fixing cover to the connector housings takes place by latching. For this, there are several catch pegs on the fixing covers, and corresponding catch recesses are formed in the side wall of the connector housing. Accordingly, the terminal housing of the fixing base terminals with the housings of the base terminals can also be mechanically connected to one another, in this case with latching taking place preferably by means of correspondingly made catch hooks and the corresponding catch grooves. In this way, the fixing base terminals can be connected to the base terminals when plugged or rotated onto a mounting rail.

According to another configuration of the electrical terminal block, the terminal housing of the fixing base terminal has the same width, preferably also the same length and the same height as the terminal housing of the base terminal. The fixing base terminal thus has the same contact spacing as the base terminals themselves, so that by using two fixing base terminals only the width of the terminal block changes, while its other dimensions remain the same.

In addition to the above described electrical terminal block, the invention also relates to a modular unit consisting of at least one connector and two fixing covers located on both sides of the connector or connectors for plugging onto a number of base terminals that corresponds to the number of connectors. In the prior art, end holders for series terminals are known, which can be plugged onto the mounting rail and can be fixed there by means of screws by which the series terminals located between the two end holders are fixed in their position in the lengthwise direction of the mounting rail. Fixing covers for connectors conversely have not been known to date. In the modular unit in accordance with this invention, the connector has a connector housing, at least one conductor terminal element located therein, and a plug-in contact electrically connected to the conductor terminal element. The fixing cover is characterized in that it has a fixing mechanism by which the modular unit can be fixed onto a corresponding number of base terminals.

Preferably, as described above, the fixing mechanism of the fixing cover is located off-center to the lengthwise direction of the fixing cover. The fixing mechanism can consist of a screw receiver and a screw.

If the modular unit consists of not only one connector, but of several connectors, they can preferably be mechanically connected to one another, for which catch pegs are formed on the side walls of the connectors and along with corresponding catch recesses, catch hooks, and catch grooves. The individual connectors can thus be combined into a corresponding connector block, according to which then the two fixing covers are slipped onto the free side walls of the outside connectors of the connector block.

Finally, the invention relates to a fixing cover for fixing on a side wall of the connector housing. The fixing cover has a fixing mechanism, which is located preferably off-center to the lengthwise direction of the fixing cover. The fixing mechanism is preferably formed by the screw receiver into which the corresponding screw can be screwed or inserted.

In particular, there are many possibilities for embodying and developing the electrical terminal block and modular unit in accordance with the invention, as will be evident in view the following detailed description and drawings.

DETAILED DESCRIPTION OF THE INVENTION

Figure 1:
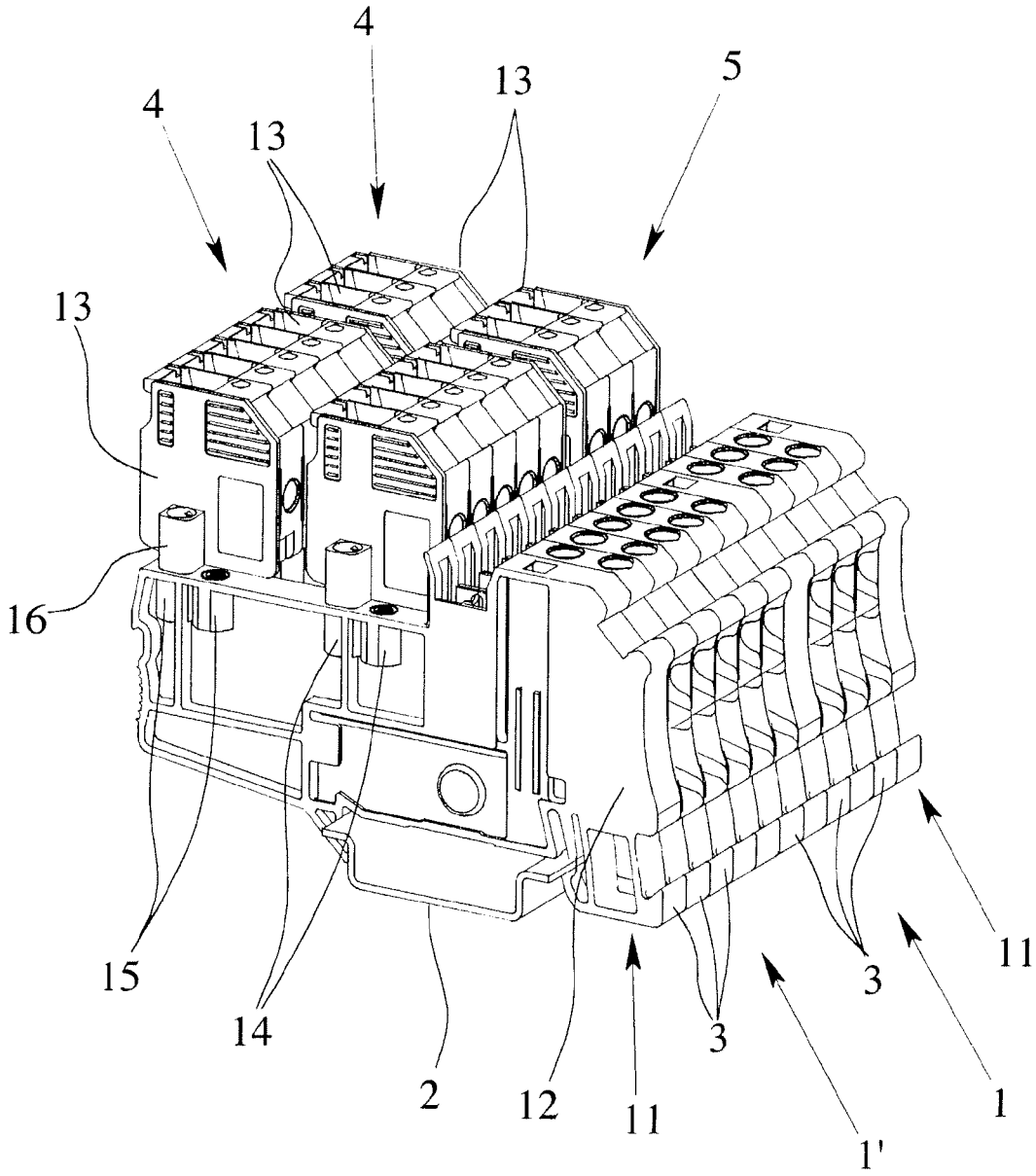
FIG. 1 is a perspective view of two electrical terminal blocks located next to one another on a mounting rail.
Figure 2:
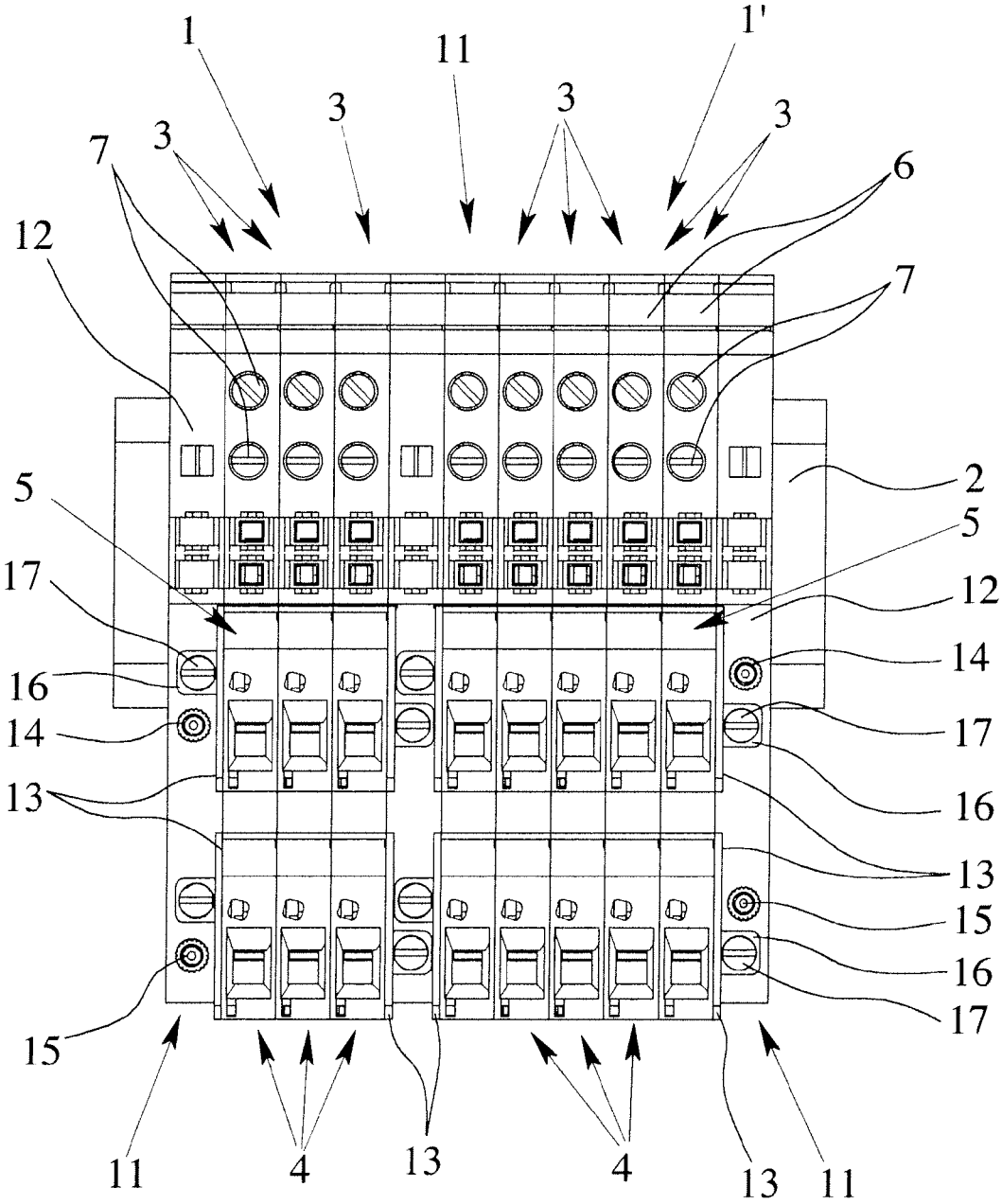
FIG. 2 is a top view of the two terminal blocks as shown in FIG. 1.

FIGS. 1 & 2 each show two electrical terminal blocks 1, 1' that are located next to one another on the mounting rail 2. The two terminal blocks 1, 1' consist of three and five base terminals 3 located next to one another and twice the number of connectors 4, 5, i.e., six and ten connectors 4, 5, with two connectors 4, 5 being plugged onto each base terminal 3. To fix the base terminals 3 on the mounting rail 2, corresponding catch elements are formed in the base of the base terminal 3, as known.

Best seen in FIG. 2, the base terminals 3 each have a terminal housing 6 made of an insulating material and two conductor terminal elements located therein. The conductor terminal elements, which are made as screw terminals, but likewise can alternatively be made as tension spring terminals, leg spring terminals or as insulating piercing terminals, are each connected to one receptacle at a time onto which the connectors 4, 5 are plugged via conductor bars, not shown. FIG. 2 shows the individual clamping screws 7 of the conductor terminal elements of the base terminals 3, which are made as screw terminals.

With respect to one alternative configuration of the individual base terminals 3, especially with regard to the configuration of the conductor terminal elements and the receptacles, reference is made to FIG. 1 of German Utility Model DE 295 14 711 U1, which shows a suitable construction. Moreover, it is also possible for the individual base terminals 3 to have only receptacles, in which case the conductor terminal elements made as screw terminals are replaced by the corresponding receptacles. Likewise, the number of conductor terminal elements and receptacles can be varied so that the invention is in no way limited to the base terminals 3 shown in the figures with two conductor terminal elements and two receptacles.

Figure 3:
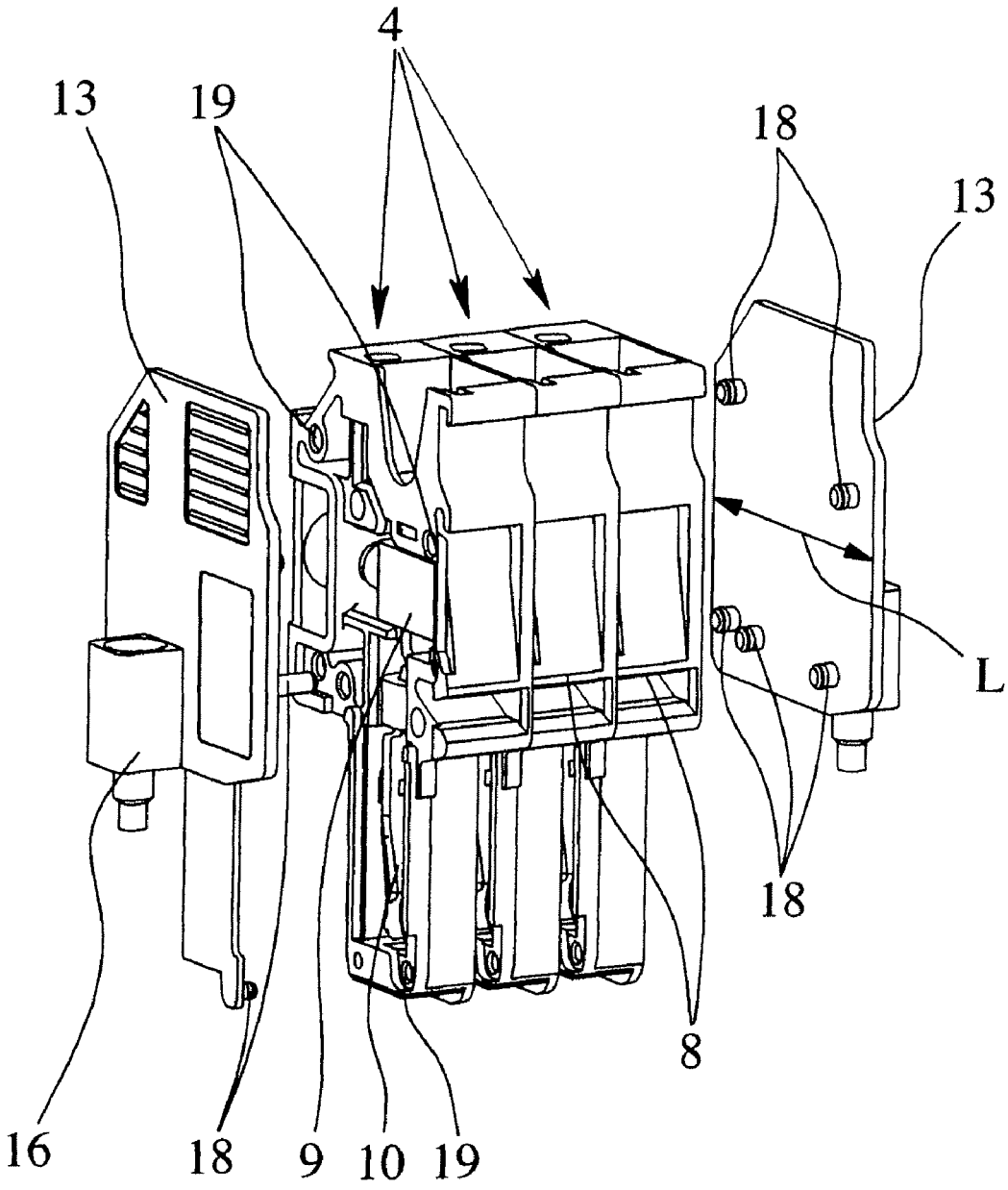
FIG. 3 is an exploded perspective view of a modular unit of three connectors and two fixing covers; and, FIG. 4 is another exploded perspective view of the modular unit as shown in FIG. 3.
Figure 4:
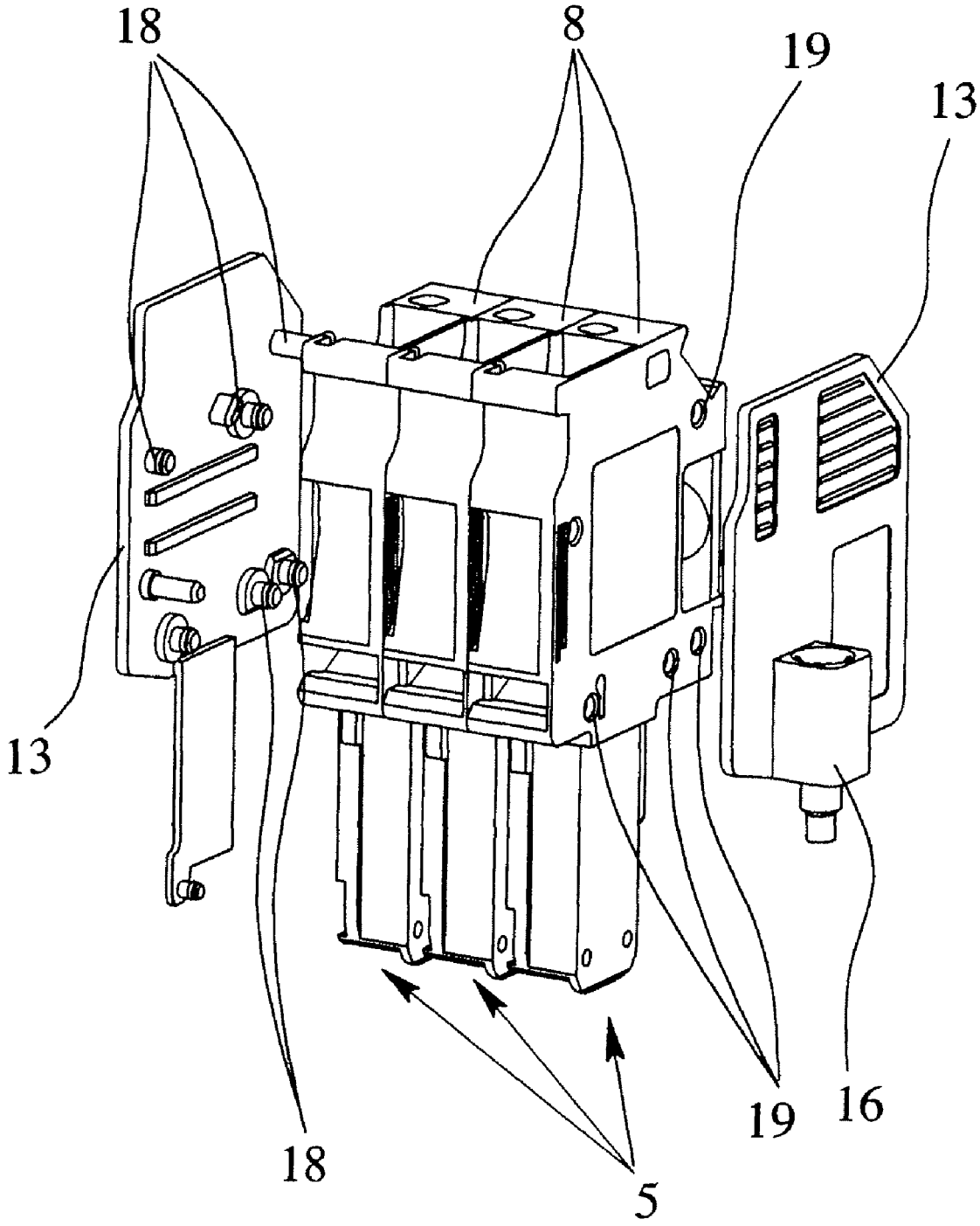

The connectors 4, 5, which are shown especially in FIGS. 3 & 4 and which are individually plugged onto one base terminal 3 at a time, in succession and perpendicular to the lengthwise direction of the mounting rail 2, each have a connector housing 8. In the connector housing 8, there is a conductor terminal element 9 and a plug-in contact 10 electrically connected to the conductor terminal element 9. In this embodiment, conductor terminal elements 9 are likewise made as screw terminals, and the plug-in contacts 10 are made as tulip-shaped sockets. Of course, for the connectors 4, 5, instead of screw terminals 9, other conductor terminal elements can also be used. Likewise, the plug-in contact 10 of the connectors 3, 4 can be made alternatively as a plug pin, rather than as a socket. Then, the receptacle located in the base terminal 3 would be made correspondingly as a socket.

On each of the outer sides of the adjacent base terminal blocks 1, 1', which each consist of a plurality of three or five base terminals 3 located next to one another, a fixing base terminal 11 is locked on the mounting rail 2. Each fixing base terminal 11 has a terminal housing 12 corresponding to the dimensions of the terminal housing 6. As is especially apparent from FIG. 2, in this connection the middle fixing base terminal 11 is assigned to the base terminal block 1 (as seen on the left) consisting of three base terminals 3 and also to the base terminal block 1' (as seen on the right) consisting of five base terminals 3, and to the pertinent connectors 4, 5. Moreover, on each side of the plurality of three or five connectors 4, 5, which are located next to one another to form a block, there is a fixing cover 13. So, each connector block 4, 5 has two fixing covers 13, one on each side. For the two terminal blocks 1, 1' locked next to one another on a mounting rail, there are three fixing base terminals 11 and four fixing covers 13, or due to the arrangement of two connectors 4, 5 per base terminal 3, eight fixing covers 13.

FIGS. 1 & 2 show that several threaded inserts 14, 15 are provided in the terminal housings 12 of the fixing base terminals 11. As shown, a total of four each, are formed. The four threaded inserts 14, 15 are arranged in pairs in succession in the lengthwise direction of the fixing base terminal 11. The first, inner pair of threaded inserts 14 are assigned to the inner connectors 4, and the second, outer pair of threaded inserts 15 are assigned to the outer connectors 5.

The fixing covers 13 each have a screw receiver 16 for a screw 17, which can be screwed into the corresponding threaded insert 14, 15 in the terminal housing 12 of the fixing base terminal 11. In this way, the threaded cover 13 and thus also the connectors 4, 5 can be attached to the fixing base terminal 11 and thus the base terminals 3. The screw receivers 16 are arranged off-center relative to the lengthwise direction of the fixing cover 13 so that two fixing covers 13 of two adjacent connector blocks 4, 4 or 5, 5 that face each other can be screwed into one of the two successive threaded inserts 14 and 15 of the fixing base terminal 11. Thus, two fixing covers 13 can be jointly fixed on opposed sides of one fixing base terminal 11 without interference.

This especially space-saving configuration is shown for the middle fixing base terminal 11 in FIG. 2. Due to the off-center arrangement of the screw receiver 16 on the fixing cover 13 and the formation of two successive threaded inserts 14 and 15 in the fixing base terminal 11, only three fixing base terminals 11 are necessary for reliable mechanical fixing of two connector blocks with four fixing covers 13. If three terminal blocks 1 are locked next to one another on a support rail, only four fixing base terminals 11 are necessary for mechanical fixing of three connector blocks with six fixing covers 13.

Using FIGS. 3 & 4, it is apparent that the fixing covers 13 can be latched to the housings 8 of the connectors 4, 5, by several catch pegs 18 protruding from the fixing cover 13 and corresponding catch recesses 19 formed in the side walls of the connector housing 8. The figures show that the terminal housing 12 of the fixing base terminal 11 has the same dimensions, especially the same contact spacing, as the terminal housings 6 of the base terminals 3. By using the fixing base terminals 11, thus only the overall width of the terminal block 1 connected in this way is increased and not its other dimensions.

As seen in FIG. 3, the fixing covers 13 also have essentially the same length L as the housing 8 of the connector 4, 5. One of the two fixing covers 13 also has the same height as the connector housing 8. So, the fixing covers 13 are used not only for mechanical fixing of the connectors 4, 5 on the base terminals 3, but also for sealing the conductor terminal elements 9 and plug-in contacts located in the connector housings 8.

Other modifications and changes can be made to the invention described herein and remain within the scope of the invention, as defined in the appended claims.

What is claimed is:

1. Modular unit comprising:

at least one electrical connector for plugging into an electrical base terminal, the connector having a housing with opposite first and second sides, at least one conductor terminal element located therein and a plug-in contact electrically connected to the conductor terminal element; and two fixing covers each of which is mountable on a respective side of the housing, each fixing cover having a fixing mechanism for connection to the electrical base terminal;

wherein the fixing mechanism of the cover for the first side of the housing is located transversely off-center relative to a lengthwise centerline thereof in a first direction while the fixing mechanism of the cover for the second side of the housing is located transversely off-center relative to the lengthwise centerline thereof in an opposite second direction so that the fixing mechanism on the cover for a first side of the housing of a first electrical connector can be attached to the electrical base terminal laterally adjacent the fixing mechanism on the cover for a facing second side of the housing of a second electrical connector.

2. Modular unit as claimed in claim 1, wherein the fixing mechanism of the fixing cover comprises a screw receiver and a screw.

3. Modular unit as claimed in claim 1, wherein each fixing cover is mechanically connected to the housing of the connector by catch pegs located on the fixing cover and catch recesses formed in the side of the connector housing.

4. Modular unit as claimed in claim 1, further comprising a plurality of connectors positioned adjacent to each other to form a block, wherein the housing of each adjacent connector is mechanically connected to each another and the fixing covers are mounted to the sides of the housings that form sides of the block.

5. Modular unit as claimed in claim 1, wherein at least one fixing cover and the connector housing have essentially the same length and the same height.

* * * * *